United States Patent [19]

Wong

[11] 4,226,031

[45] Oct. 7, 1980

[54] SANDAL

[76] Inventor: James K. Wong, 46-194 Nona Loop, Kaneohe, Hi. 96744

[21] Appl. No.: 916,463

[22] Filed: Jun. 19, 1978

[51] Int. Cl.[3] ..... A43B 3/12

[52] U.S. Cl. ..... 36/11.5

[58] Field of Search ..... 36/11.5, 30 R, 103, 36/104, 110, 32 R, 59 R

[56] References Cited

U.S. PATENT DOCUMENTS

| | | | |
|---|---|---|---|
| 1,808,063 | 6/1931 | Paterson | 36/32 R |
| 2,758,395 | 8/1956 | Miyaji | 36/11.5 |
| 3,584,402 | 6/1971 | Silverman | 36/11.5 |
| 4,043,058 | 8/1977 | Hollister et al. | 36/102 |
| 4,069,601 | 1/1978 | Robbins et al. | 36/11.5 |

*Primary Examiner*—Patrick D. Lawson

*Attorney, Agent, or Firm*—Freilich, Hornbaker, Wasserman, Rosen & Fernandez

[57] ABSTRACT

A sandal useful especially in wet areas and also where there is soft ground such as at the beach. The sandal has opposite side edges that slope in a downward-outward direction, to provide a wider foot print that minimizes sideward twisting on soft ground, to avoid splashing of water onto the wearer, and to avoid disintegration of the side portions of soft rubber sandal material. The bottom surface of the sandal slopes upward at the rear and front to further avoid splashing of water onto the wearer. The lower surface of the sandal has a herring-bone pattern, with each ridge interrupted by narrow cross projections that help avoid slipping due to hydro-planing.

1 Claim, 9 Drawing Figures

FIG. 5
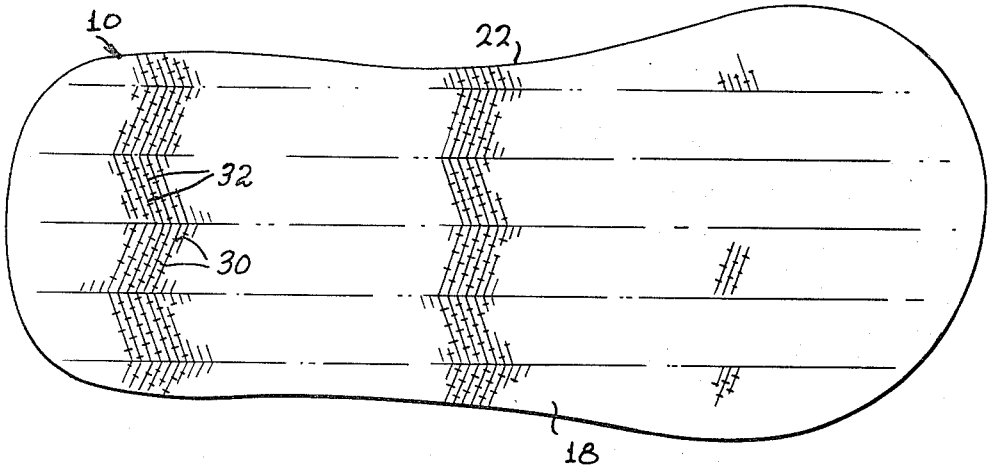
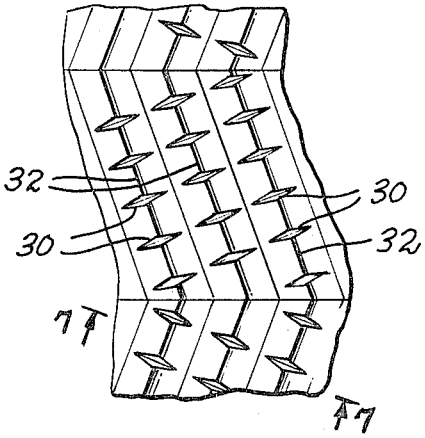
FIG. 6
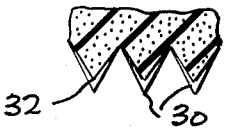
FIG. 7
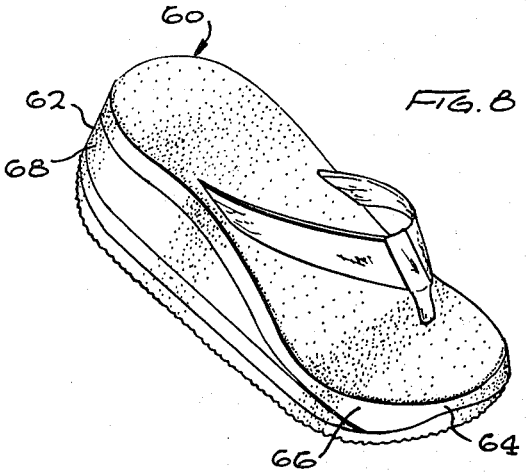
FIG. 8
FIG. 9
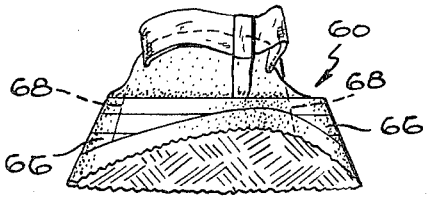

SANDAL

BACKGROUND OF THE INVENTION

Typical sandal designs utilize a simple slab of elastomeric material formed with a flat bottom and vertical sides. Such sandals have many disadvantages, particularly when utilized at the beach or near a swimming pool and when the wearer runs or makes sudden stops or turns. In wet areas, the sandals easily splash water onto the person's foot and back. Where the ground is very soft, such as on loose sand, the sandal easily turns to one side, since the holding straps do not easily permit a person to prevent such turning as is possible with shoes, and this can lead to injuries to the foot. On hard wet areas such as on the deck surrounding a swimming pool, there is a danger that the sandal can hydroplane on the water and cause the person to slip and fall. Over an extended period of use, a common type of damage to sandals formed of slabs of elastomeric material, is pocking of the sides of the sandal, resulting from repeated outward bulging of the side edges due to the weight of the person compressing the slab of material. A sandal that avoided many of the most common problems with sandals, would provide added protection to the user against splashing and injury, and provide a longer lifetime of use of the sandal.

SUMMARY OF THE INVENTION

In accordance with one embodiment of the present invention, a sandal is provided which is safe and protective of the wearer. The sandal includes a base held by a strap to the user's foot, the base having outwardly-downwardly sloping sides that provide a wider foot print for the wearer, and the base having upwardly sloped rear and forward portions. The larger foot print minimizes tilting of the sandal when making sudden stops or turns or when walking on soft ground, while also avoiding sideward and backward splashing onto the wearer. The upwardly sloped front and rear portions avoid splashing of water at the front and rear of the sandal. The bottom surface of the sandal can be formed in a herringbone pattern for good traction, but with a multiplicity of cross projection on the ridges of the herringbone pattern to prevent hydroplaning of the sandal on a hard wet surface.

A highly decorative sandal can be formed by utilizing a multi-layer slab of moderate cost elastomeric material which has upwardly sloped front and rear portions, a bottom layer of good wearing material, and a thin stripping layer between the bottom layer and the rest of the sandal. In order to maintain a uniform apparent thickness of the lower pinstripe layer, the front and rear edges of the sandals are ground at a downward-outward angle so they are formed largely perpendicular to the upwardly sloped stripe layer.

The novel features of the invention are set forth with particularity in the appended claims. The invention will be best understood from the following description when read in conjunction with the accompanying drawings.

BRIEF DESCRIPTION OF THE DRAWINGS

FIG. 5 is a bottom view of the sandal of FIG. 1.

FIG. 6 is an enlarged view of a portion of the sandal of FIG. 5.

FIG. 7 is a view taken on the line 7—7 of FIG. 6.

FIG. 8 is a perspective view of another embodiment of the sandal, showing a woman's version thereof.

FIG. 9 is a front elevation view of the sandal of FIG. 8.

DESCRIPTION OF THE PREFERRED EMBODIMENTS

Figure 1:
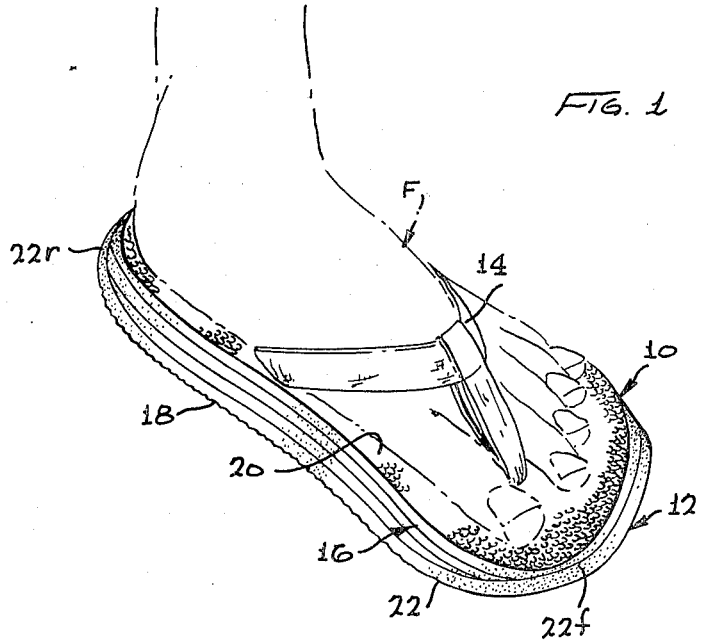
FIG. 1 is a perspective view of a sandal constructed in accordance with one embodiment of the present invention.

FIG. 1 illustrates a sandal 10 which includes a base 12 and a strap 14 for holding the foot F of a person to the base. As also shown in the other figures, the base includes a multi-layer upper portion 16 formed of moderate cost elastomeric material such as rubber, and a bottom or sole layer 18 of wear resistant material such as a molded urethane. The base 12 has an upper surface 20 of a size and shape which is designed to support all portions of the foot of a wearer, with only moderate overlap beyond the wearer's foot. Thus, for a given size sandal such as a 9C size, the upper surface 20 is of the same size as would be found for conventional prior art sandals having the same size designation. However, the sandal is different from the conventional sandals in several respects, including the fact that the bottom surface 22 of the base is much wider than the upper surface 20, and has a forward portion **22*f* and a rearward portion 22*r*** that both slope upwardly instead of lying substantially at the same level as the middle of the sandal.

Figure 2:
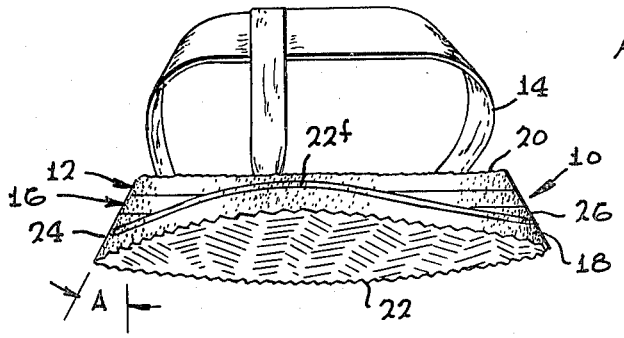
FIG. 2 is a front elevation view of the sandal of FIG. 1.
Figure 4:
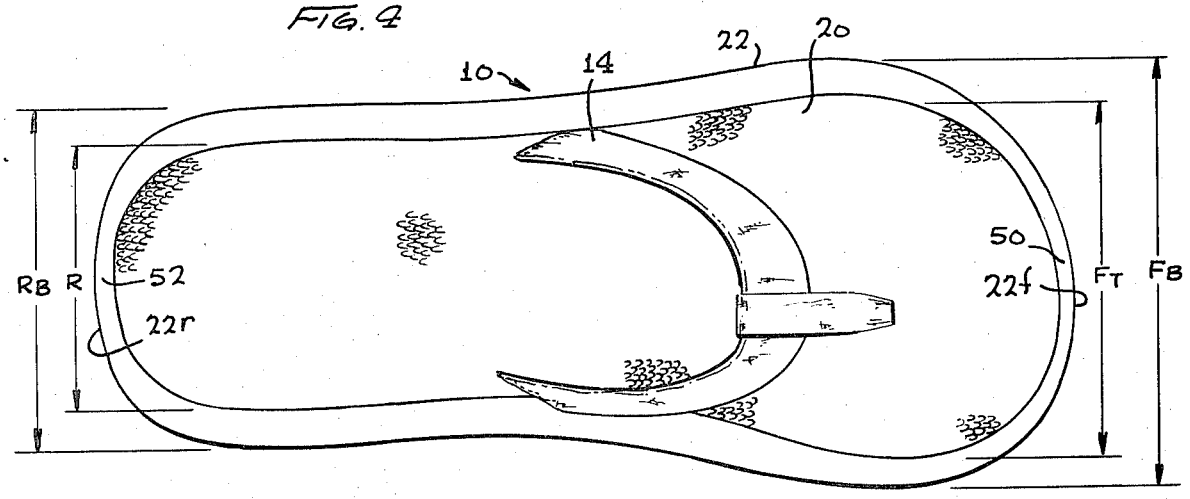
FIG. 4 is a plan view of the sandal of FIG. 1.

As shown in FIG. 2, the side edges 24, 26 of the sandal are sloped in a downward-outward direction by an angle A from the vertical of about 25° to 30°. For an average men's size sandal, with a rear portion having a width R (FIG. 4) of about 6.5 centimeters, the 25° to 30° sloping over a sandal height of about 3 centimeters results in a width $R_B$ of about 9.5 centimeters, or about 40% more than the width of the top. At the widest forward portion of the sandal, the top has a width $F_T$ of about nine centimeters while the bottom width $F_B$ immediately thereunder has a width of about 12 centimeters or about one-third as much. The greater width of the bottom surface 22 of the sandal results in a wider footprint. On soft ground such as on sandy beaches, or when making sudden stops or turns, such a wider foot print is useful in avoiding sideward tilting of the sandal. In the case of an ordinary shoe, which includes an upper part closely surrounding the foot of the wearer, the wearer can apply considerable sideward torque to avoid undue tilting of his foot to the side. However, in the case of sandals wherein the straps 14 serve only to hold the sandal to the wearer's foot but not to enable substantial sideward torque to be applied, the wearer cannot easily prevent tilting of the sandal. A large sideward tilting can cause injury to the wearer's foot. By providing a wider foot print for the sandal wearer, the possibility of such tilting and consequent injury is minimized. Of course, the wearer could resort to an ordinary shoe to further minimize the possibility of such injury, but an ordinary shoe is not considered as comfortable on a sandy beach, since it holds sand particles, and prevents exposure of the foot to the sunlight for even tanning and for drying out of moisture.

The downwardly-outwardly sloped sides 24, 26 of the sandal have an additional advantage in avoiding disintegration of the sandal at its sides. The elastomeric layers of typical sandals with vertical side edges, bulge outwardly at the side edges. This outward bulging produces tension in the edge surface of the elastomeric layers, which can lead to cracking and pocking of the layer at the edges. In fact, such cracking and pocking is a major cause of shortened sandal life. By utilizing sloping sides 24, 26, the weight of the wearer can be distributed downwardly and outwardly to the larger foot print at the bottom of the sandal. The edges 24 & 26 do not bulge outwardly appreciably, and are not subjected to localized tension forces that will cause cracking and pocking to limit sandal life.

The wider foot print afforded by the sloping side edges 24, 26 of the present sandal, have been found to offer the additional benefit of minimizing the effects of splashing. When a wearer steps into a puddle of water, the water tends to splash to the side and also upwardly. Since the wearer's foot is perhaps one-half inch inside of the boundaries of the bottom surface 20 of the sandal, upward splashing of the water will not result in the water falling on him, or at least minimizes this possibility.

An even more common source of annoying splashing, arises from the compression of water at the front of the sandal as it is rapidly laid down onto a wet surface, with the front of an ordinary sandal hitting the surface hardest and causing the greatest degree of splashing. The upwardly sloped lower sandal surface at **22*f* helps avoid this cause of splashing, by the fact that it normally does not move down against the ground when a person lays down his foot. This upward sloping also provides a different feeling when the person begins to take another step, since it allows him to roll his trailing foot upward, on the slope forward surface 22*f*, instead of providing a sharp corner. The rearward lower surface 22*r*** of the sandal is also outwardly sloped, to minimize splashing and also to provide a better feel as a sandal begins to be laid down onto the ground in walking.

In addition to widespread use of sandals on sandy beaches, they are also widely used on slick wet surfaces such as the deck surrounding a pool. One danger that can occur when walking or running on such surfaces, is hydroplaning, wherein a forwardly moving sandal slides on a film of water lying on a smooth and hard surface. To avoid such hydroplaning, the bottom surface 22 of the sandal is formed in a unique pattern. This pattern includes a conventional herringbone groove arrangement, with the addition of cross projections 30 that project from the ridges 32 of the herringbone pattern. The cross projections, also shown in FIGS. 6 and 7, provide spaced narrow projections that will penetrate a film of water to contact a hard surface so as to avoid hydroplaning of the sandal. The projections 30 are molded into the plastic material of the sole layer 18 of the sandal, and project only a small distance below the ridges 32 of the herringbone pattern of the sole layer, so that they are easily compressed to permit the ridges 32 to support a considerable amount of the foot when walking on an ordinary non wetted hard surface.

Figure 3:
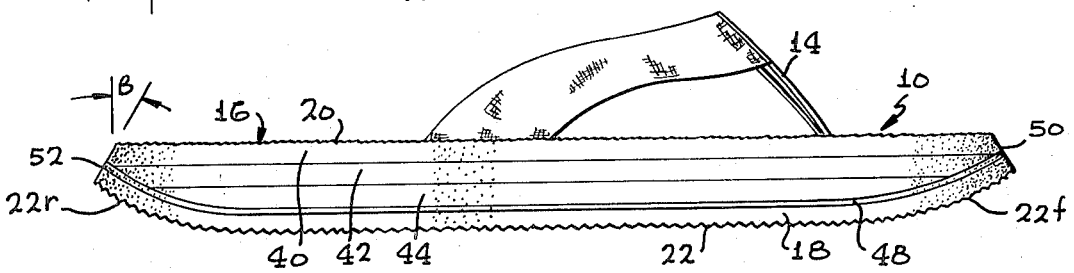
FIG. 3 is a side elevation view of the sandal of FIG. 1.

The sandal as best shown in FIG. 3, can be constructed by first forming the upper portion 16 by gluing together a series of differently colored rubber layers 40–46. In one design for men's sandals, uppermost layer 40 is black, intermediate layer 42 is light blue, and intermediate layer 44 is a very dark blue. The glued-together layers 40–44 are then ground to provide smooth upwardly-sloped forward and rearward portions as shown. The strap 14 is then inserted through slots in the layers. A decorative white layer 48 is then glued to the bottom of the multi-layer upper portion 16, and the bottom or sole layer 18 is then glued to the bottom of the decorative stripe layer 48.

In order to provide a neat appearance for the sandal, in spite of the tapering of the layers 40–44 it is found necessary that the white lower pinstripe layer 48 have a uniform apparent thickness at all regions, including the front and rear portions of the sandal. In early production of the sandal, the front and rear edges 50, 52 of the sandal were ground in the conventional manner which is perpendicular to the upper surface 20. This was found to result in the stripe layer 48 having an unusual thinning at the front of the sandal, which interferes with a neat appearance. To avoid this, the front and rear edges 50, 52 are ground approximately perpendicular to the upwardly sloped surface such as **22*f*. This results in the stripe layer 48 being ground perpendicular to its faces even at the front and rear, and therefore the apparent thickness of the stripe 48 is the same at all regions of the sandal. A grinding of the front edge 50 at an angle B of about 25°, which is about the same as the angle A for the side edges of the sandal, was found satisfactory. The same angle of slope was found satisfactory also for the rear edge 52**.

FIGS. 8 and 9 illustrate a sandal 60 of a woman's fashion type, which includes a raised heel portion. The sandal is of a construction similar to that of the men's sandal of FIGS. 1–7, except that the heel portion 62 has a thickness about 50% greater than the thickness of the front portion 64 which is about the same thickness of about 3 centimeters as found in the men's sandal. The front portion 64 has sides 66 extending at about a 25° slope. However, the side edges 68 at the thickened heel portion of the sandal are angled at a smaller slope such as about 15° to 20° from the vertical to avoid an excessively wide heel foot print that might appear awkward. The bottom of the heel portion 62 is still about 40% wider than the top of the heel portion due to the considerable thickness of the heel portion. In one woman's sandal, the upper surface of the heel portion 62 had a width of 6.5 centimeters, while the bottom surface had a width of 9 centimeters.

Thus, the invention provides a sandal which is especially useful for walking on wet and soft ground, which protects the foot of the wearer against twisting, splashing, and hydroplaning. The sandal is provided with downwardly-outwardly sloped sides that provide a much wider foot print least about 25% greater than the width of the top of the sandal on which the foot of the wearer rests. This wider foot print helps avoid sideward tilting of the sandal which could injure the wearer. Such a wider foot print, in addition to outward sloping of the bottom sandal surface at the front and rear, helps avoid splashing of water onto the wearer. The bottom surface of the sandal is formed with ridges, as in a herringbone pattern, wherein cross projections are provided on the ridges that can pierce a water film to prevent hydroplaning of the sandal on a hard wet surface.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A decorative sandal, comprising:

a base; and strap means for holding a foot to the base;

said base including an upper base portion, a stripe layer lying generally against the bottom of the upper base portion, and a tough sole layer lying against the bottom of the stripe layer;

said upper base portion being tapered in thickness, so it is progressively thinner at progressively more forward locations, and the stripe and sole layers extending at an upward-forward incline near the front of the base;

the extreme front edge of said base being angled from the vertical so it extends perpendicular to the front end of the stripe layer, as seen in a side elevation view, whereby to keep the thickness of the stripe layer uniform at the front and sides of the sandal.

* * * * *